US005722851A

United States Patent [19]

Onizuka et al.

[11] Patent Number: 5,722,851

[45] Date of Patent: Mar. 3, 1998

[54] CIRCUIT COMPONENT AND JUNCTION BOX FOR CONNECTING FLAT CABLES

[75] Inventors: Takahiro Onizuka; Hideo Matsuoka, both of Yokkaichi, Japan

[73] Assignee: Sumitomo Wiring Systems, Ltd., Japan

[21] Appl. No.: 599,979

[22] Filed: Feb. 14, 1996

[30] Foreign Application Priority Data

Feb. 15, 1995 [JP] Japan ..... 7-027027

[51] Int. Cl.[6] ..... H01R 4/24

[52] U.S. Cl. ..... 439/404; 439/949; 439/402; 439/76.2

[58] Field of Search ..... 439/404, 402, 439/403, 405, 422, 492, 498, 395, 949, 44, 76.2, 714

[56] References Cited

U.S. PATENT DOCUMENTS

| | | | |
|---|---|---|---|
| 4,249,303 | 2/1981 | Weinmann et al. . | |
| 4,364,622 | 12/1982 | Huntley | 439/402 |
| 4,429,940 | 2/1984 | Freshwater et al. | 439/404 |
| 4,902,241 | 2/1990 | Lockard | 439/395 |
| 4,938,719 | 7/1990 | Sawai et al. | 439/404 |
| 5,057,026 | 10/1991 | Sawai et al. | 439/714 |
| 5,653,607 | 8/1997 | Saka et al. | 439/44 |

FOREIGN PATENT DOCUMENTS

| | | |
|---|---|---|
| 56-13674 | 2/1981 | Japan . |
| 60-35911 | 2/1985 | Japan . |
| 2141593 | 12/1984 | United Kingdom . |

*Primary Examiner*—Gary F. Paumen
*Assistant Examiner*—Tho D. Ta
*Attorney, Agent, or Firm*—Bierman, Muserlian and Lucas

[57] ABSTRACT

A circuit component having a plurality of flat cables each formed by covering a group of parallel wires with a thick layer of insulating resin. The cables are superposed and preferably arranged so that their axes are not parallel. Cramping terminals are inserted into flat cables from above and below in specified predetermined positions, and are securely held therein. Wire contacts of the cramping terminals are connected to specific wires by penetrating the wire coatings means of cutters. The cramping terminal may be formed with a tab which forms an external terminal and connects the wire(s) therewith. The cramping terminals may also connect two or more wires of the same flat cable conductor member or of different flat cables, thus forming the desired circuit. A circuit component, including the desired circuit is separately formed in advance. A junction box is completed merely by mounting the preformed circuit component in the casing thereof.

18 Claims, 5 Drawing Sheets

CIRCUIT COMPONENT AND JUNCTION BOX FOR CONNECTING FLAT CABLES

This Application claims the priority of Japanese Application 7/27027, filed Feb. 15, 1995.

The present Invention relates to a component of a desired circuit in an electrical junction box, especially for use in connection with flat cables, and a junction box containing the component.

BACKGROUND OF THE INVENTION

An electrical junction box used to establish branch connections, especially between wiring harnesses for automotive vehicles and a variety of electrical devices, is designed to concentrate the connections in one place and, at the same time, permit economical production thereof. As the wiring harnesses get more and more compact, a variety of junction boxes for different types of vehicles and different purposes has been developed. These boxes include one in which the circuit is formed, after one wire is arranged on the inner surface of each of the upper and lower casings, by connecting cramping terminals to the desired wires. The prior art boxes require an apparatus for arranging the wires; thus, if the specific circuit is changed, the apparatus also must be modified. Also, if the circuit is complicated (as it usually is), substantial time is required just to arrange the wires prior to completing the assembly.

A known connector for flat cables is shown in FIGS. 5(A) and 5(B) (see Japanese Unexamined Patent Publication 56-13674). Specifically, lower flat cable 3 has thickened portions which are fitted in grooves 1*a* on the inner surface of lower casing 1; upper flat cable 4 has thickened portions which similarly are fitted in grooves 2*a* on the inner surface of upper casing 2. Flat cables 3 and 4 are perpendicular to each other, but in substantially parallel planes. Lower wire contacts 6*a* of cramping terminals 6 are secured on main body 5 between lower casing 1 and upper casing 2, and are connected to wires 3*a* of the lower flat cable 3. Analogously, upper wire contacts 6*b* of cramping terminals 6, electrically connected to lower contacts 6*a* by intermediate portion 6*c*, are connected to wires 4*a* of upper flat cable 4. In the above prior art connector, the circuit is formed by connecting wires 3*a* and wires 4*a* by means of cramping terminals 6.

However, grooves 1*a* and 2*a* for positioning flat cables 3 and 4 must be formed on the inner surfaces of lower and upper casings 1 and 2, thereby making the structure of the casings complicated and engendering increased production costs. Further, if the spacing between the wires of the flat cables, or the directions in which the wires extend, is changed, this connector is rendered useless thereby. Moreover, it is also necessary to provide connector main body 5 and to bury and secure intermediate portions 6*c* of cramping terminals 6 therein. This increases the number of parts, and the production costs due to an increased labor. In addition, casings 1 and 2 must be made thicker to accommodate connector main body 5. It is a particular drawback of the prior art device that, since cramping terminals 6 are buried and secured, it is difficult to modify the device to accept a change in the circuit being manufactured.

SUMMARY OF THE INVENTION

Therefore, it is an object of the present Invention to provide an improved junction box and associated circuit components which can be produced at reduced cost and can easily be modified to accommodate changes in circuit design.

According to the Invention, there is provided a circuit component for forming a desired circuit in an electrical junction box, the component comprising a plurality of flat cables, each having a plurality of wires, with adjacent flat cables arranged in a predetermined pattern. Preferably, adjacent cables are superposed and their axes are other than parallel. The component also includes cramping terminals, insertable into at least one flat cable, electrically connected in predetermined fashion to the wires. According to a preferred embodiment, the flat cables are mechanically connectable to each other by the cramping terminals in a self-supporting manner. Advantageously, the cramping terminals are insertable from either or both sides of each flat cable into at least one other flat cable in specified positions. According to a particularly useful embodiment, each cramping terminal has at least one wire contact including cutters, whereby the wire contact penetrates the insulation to make electrical contact with the desired wire(s). It has also been found of advantage to provide spaces between the flat connecting portions of adjacent superposed flat cables. The cramping terminals preferably also electrically connect the predetermined wires with external terminals, in particular by tabs formed thereon, as well as connecting the predetermined wires of the same flat cable and/or the wires of different flat cables.

Special mention is made of the embodiment wherein at least some cramping terminals are long enough to simultaneously be connected with the wires of two or more superposed flat cables, especially when the cramping terminal is inserted into the flat cable from above or below. Portions of the flat cables which are not required for the circuit are desirably cut off.

According to the Invention, there is further provided an electrical junction box comprising at least one circuit component of the foregoing type, and a casing having terminal holes. The circuit component is mounted inside the casing so that the cramping terminals thereof project outwardly through the terminal holes. A noteworthy modification of the present Invention comprises ribs on the inner surfaces of the casings, the circuit component being mounted in contact with the ribs, thereby creating a clearance between the circuit component and the inner surfaces of the casings.

It is a feature of the Invention that the circuit component is produced separately from the junction box; thus, the box can be assembled merely by mounting the circuit component in the casing of the junction box. In other words, the Invention facilitates changes in the circuits being produced and makes the entire junction box thinner and simpler to assemble. Moreover, the inventive flat cables have a thick resin sheath which provides rigidity sufficient to securely hold the cramping terminals.

DETAILED DESCRIPTION OF THE INVENTION

A specified number of flat cables are arranged one over another and rotationally shifted with respect to each other by a desired angle, e.g. 90°. The cramping terminals are inserted directly into the flat cables in specified positions to connect desired wires of different (usually adjacent) flat cables or desired adjacent wires of a single flat cable, thereby forming the circuit. The cramping terminals include, for example, those having a tab at one end to be connected to an external terminal and having, at the other end, cutters for penetrating the coating of the wire. This permits connection of the wire to the external terminal, a plurality of wires of the same or different flat cables to connect these wires to the external terminal, or to connect a plurality of wires of the same or different flat cables. By connecting the wires of the flat cables by the cramping terminals, a designed circuit can be formed of parallel wires in the flat cables. In other words, bending of the wires, which is necessary in the prior art, can be eliminated, with the result that the wires can be arranged in a more compact manner.

As is clear from the above description, a plurality of flat cables of the type described herein is superposed and the cramping terminals are inserted directly into the flat cables to create the desired circuit. The cramping terminals are securely held in the flat cables; this enables the formation of the circuit component in advance and independently of the casings of the junction box.

Therefore, unlike the prior art, it is not necessary to form positioning grooves on the inner surfaces of the upper and lower casings of the junction box. Further, since the cramping terminals are directly connected to the wires of the flat cable(s), the connector main body deemed essential in the prior art is not required. Consequently, the casings can be thinner by an amount equal to the thickness of the main body, thereby making the entire junction box thinner. This is accomplished with a reduction in both the number of parts and the amount of labor. Since the cramping terminals are directly inserted and connected with the wires of the flat conductor members arranged one over another, the circuit can be easily changed. Furthermore, unlike the prior art wherein the wires are arranged one by one, a wire arranging apparatus and a labor required therefore are not necessary.

Also, the wires of the respective flat cables can be arranged to intersect at almost any desired angle. If the wire contacts of the cramping terminals are given sufficient length, they can simultaneously connect the wires of different flat cables and the cramping terminals can be easily and rapidly mounted from one direction, i.e. from above and/or below. Further, by extending the horizontal dimension of the cramping terminal by a specified distance, the cramping terminal can connect the wires arranged in parallel in the same flat cable.

Moreover, portions of the cables which are not required for the circuit may be eliminated. For example, cables having the same rectangular shape can be superposed so that the wires of one flat conductor member intersect with the wires of the other at right angles, and the cramping terminals are inserted to form the desired circuit. Thereafter, the portions of the flat conductor members which are not required for the circuit are cut off e.g. by means of a press. If this is done, the flat cables can be efficiently mass-produced in a given shape.

In another modification of the Invention, the upper and lower casings of the junction box are each formed with terminal holes, wherein the preformed circuit component is mounted in the space defined by the lower and upper casings and the tabs of the terminals extend through the terminal holes and project out of the junction box. Accordingly, the junction and circuit box can be easily completed merely by mounting the preformed circuit component therein.

Preferably, ribs are formed on inner surfaces of the upper and lower casings, and the circuit component is mounted so that it is in contact with projecting ends thereof. Thus, there is a clearance between the circuit component and the inner surfaces of the casings. Hence, the ribs prevent the ends of the cramping terminals from being damaged by coming into contact with the inner surfaces of the casings.

In other words, the casings have no need for the positioning grooves of the prior art shown in FIG. 5; in addition, they have a simple shape which is capable of housing a circuit component member of any construction, so long as the terminal holes are in conformity with the tabs of the cramping terminals thereof.

BRIEF DESCRIPTION OF THE DRAWINGS

The accompanying drawings, constituting a part hereof and in which like reference characters indicate like parts.

FIG. 5 (B) is a perspective view of a prior art cramping terminal.

DETAILED DESCRIPTION OF THE INVENTION

Figure 1:
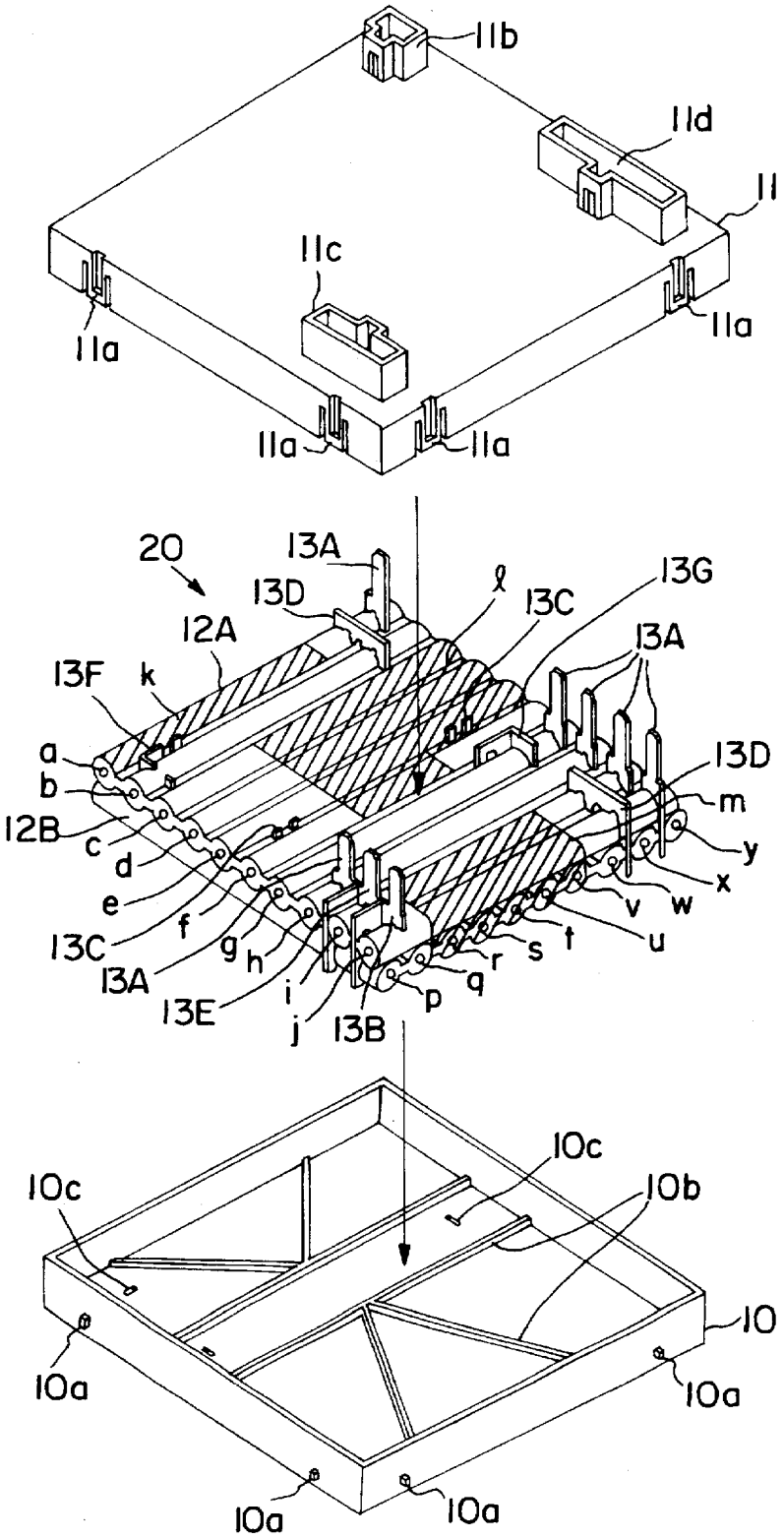
FIG. 1 is an exploded perspective view of the junction box of the Invention.

As shown in FIG. 1, a circuit component 20 is preformed and is mounted in the interior of a junction box comprising thin rectangular lower casing 10 and upper casing 11, preferably made of synthetic resin. Lower casing 10 and the upper casing 11 are assembled by fitting the inner surfaces of the side walls of upper casing 11 over the outer surfaces of the side walls of lower casing 10 and by engagement of locking claws 10*a* of lower casing 10 with locking holes 11*a* of upper casing 11. Upward projecting connector receptacles 11*b* to 11*d* project from the upper surface of upper casing 11.

Ribs 10*b* are in specified positions on the inner bottom surface of lower casing 10; although unillustrated, similar ribs are formed on the inner upper surface of upper casing 11. Ribs 10 both reinforce the inner surfaces of casings 10 and 11 and prevent cramping terminals 13A to 13I from coming into contact therewith.

Figure 2A:
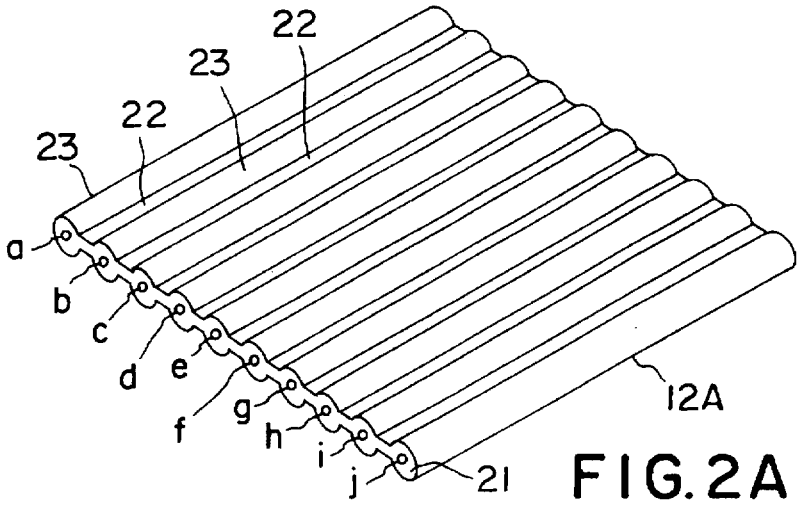
FIG. 2A is a perspective view of the upper flat cable.
Figure 2B:
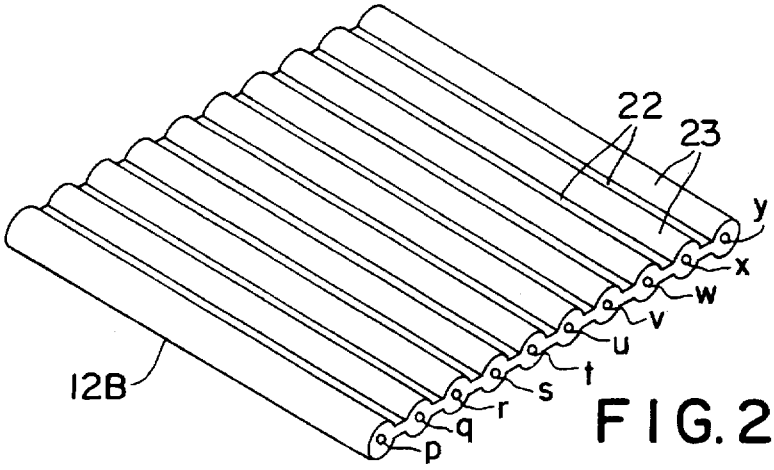
FIG. 2B is a perspective view of the lower flat cable.
Figure 2C:
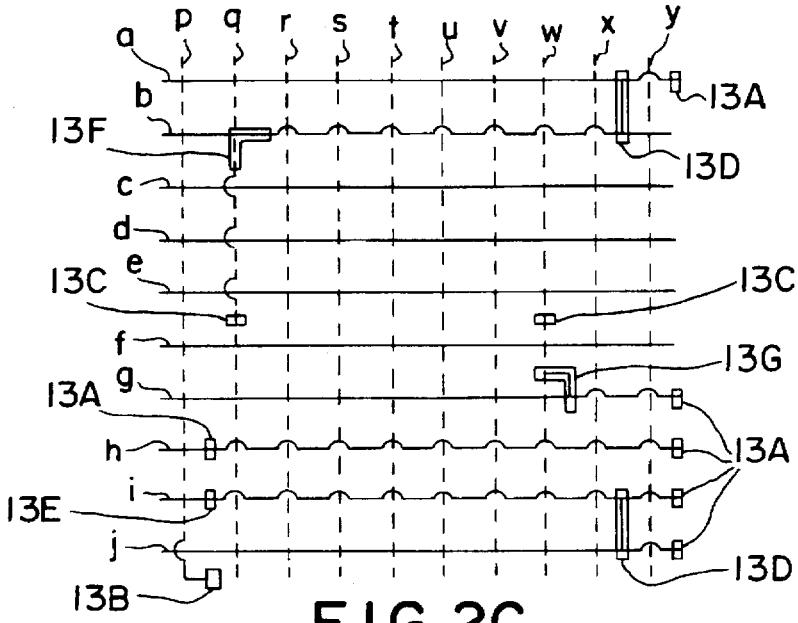
FIG. 2C is a schematic view of the wires of the superposed flat cables.
Figure 3A:
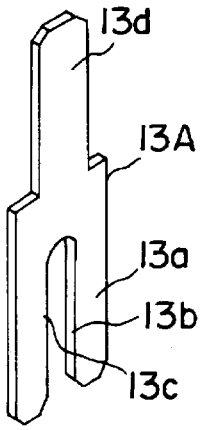
FIGS. 3(A) to 3(G) are perspective views of various typical cramping terminals.
Figure 3B:
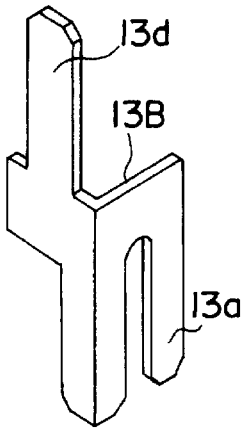
Figure 3C:
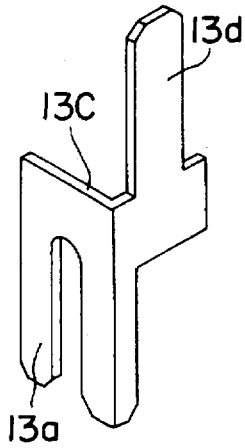
Figure 3D:
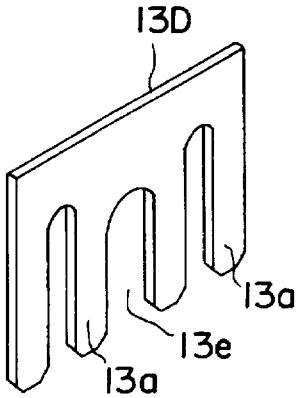
Figure 3E:
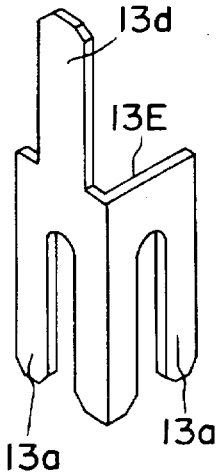
Figure 3F:
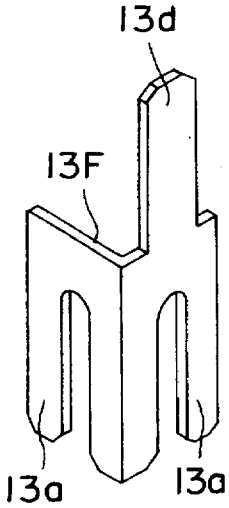
Figure 3G:
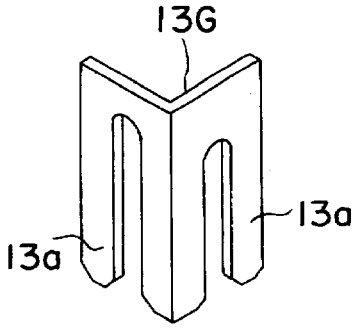

As shown in FIGS. 1, 2A, and 2B, circuit component 20 includes flat cables 12A and 12B molded to contain a plurality of wires a to j and p to y (10 wires each in this embodiment). The wires in each of the foregoing groups are parallel to each other and are covered with insulating sheaths 21. Each flat cable is substantially rectangular and wire coatings 23, which bulge upward and downward, are connected by flat connecting portions 22. connecting portions 22 and wire coatings 23 conform to the pitch of the cramping terminals. The width of connecting portions 22 is not limited. Insulating sheath 21 is thicker than the sheaths of prior art flat cables so that cables 12A and 12B have the desired rigidity. Flat cable 12A is superposed on flat cable 12B so that wire coatings 23 of one cable are in contact with those of the other cable and connecting portions 22 of one flat conductor member are spaced apart from those of the other connecting member. Wires a to j of upper cable 12A intersect with corresponding wires p to y of lower cable 12B at a right angle. The wires therefore form a checkerboard pattern as shown in FIG. 2C; the solid lines extending in the lateral direction represent wires a to j and broken lines extending in the vertical direction represent wires p to y.

Figure 4A:
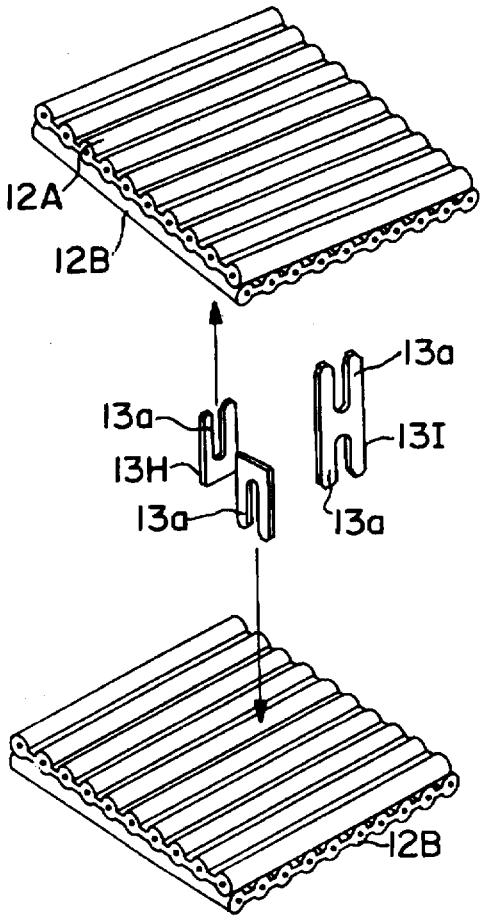
FIG. 4 (A) is a perspective view of the upper and lower flat cables showing the insertion of the cramping terminals.
FIG. 4(B) is a perspective view, similar to that of FIG. 4A, showing upper and lower flat conductor members having a cut out portion in the upper cable.
Figure 4B:
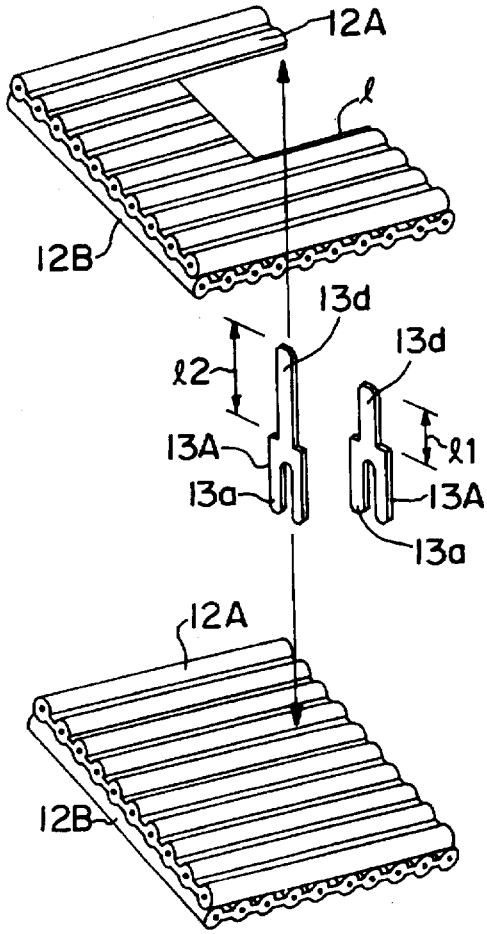

Each of cramping terminals 13A to 13G, shown in FIGS. 3(A) to 3(G), basically includes wire contact 13*a* to be inserted from above (in the case of cable 12A) or from below (in the case of cable 12B) and to be connected to one or more of wires a to j or p to y as is appropriate. Each wire contact 13A has slot 13*b* which is provided with cutters 13c on the inner edges thereof. Cramping terminal 13A is provided with tab 13*d* adapted for connection to an external terminal (not shown). Tabs 13*d* may be of different lengths 11 and 12, as shown in FIG. 4(B).

Cramping terminal 13B is provided with tab 13*d*, perpendicular to the upper edge of wire contact 13*a*, and located above the left part thereof. Cramping terminal 13C comprises tab 13*d*, perpendicular to the upper edge of wire contact 13*a*, and projecting from the upper right part thereof.

Cramping terminal 13D has two wire contacts 13*a* on opposite sides of intermediate slot 13*e*, but has tab. In other words, this terminal is used to interconnect wires, but not to make contact with an external terminal. Cramping terminal 13E also has two wire contacts 13*a*, but these extend at a right angle to each other, and tab 13*d* projects from upper left wire contact 13*a*. Cramping terminal 13F has the same two wire contacts 13*a*, a right angle to each other, but tab 13*d* projects from the right wire contact. Cramping terminal 13G has two wire contacts 13*a* at a right angle to each other, but tab 13*d* is omitted; as in the case of terminal 13D, cramping terminal 13G is used only to interconnect wires. The foregoing seven different cramping terminals 13A to 13G are only examples; a variety of differently shaped cramping terminals suited to forming a circuit can be used within the scope of the Invention.

As best shown in FIG. 1, six cramping terminals 13A, inserted from above, are connected to the right ends of the wires a and g to j, while one is connected at the left end of wire h. One cramping terminal 13B, inserted from above, is connected to the right end of wire p; two cramping terminals 13C, inserted from below, are connected to wires q and w of the lower flat conductor intermediate their ends, and two cramping terminals 13D, inserted from above, connect wires a and b, and i and j at their right ends.

One cramping terminal 13E, inserted from above, is connected to both the left end of wire i and the right end of wire p; one cramping terminal 13F, inserted from below, is connected to the left end of wire q and to the left end of wire b; and one cramping terminal 13G, inserted from above, connects wire g with the wire w intermediate their ends.

As described above, the circuits are formed by inserting cramping terminals 13A to 13G directly into flat cables 12A and 12B from above or below, thereby making the desired wire connections. More specifically, the cramping terminals may be connected to one or more wires of one of the flat cables through flat connecting portion(s) 22 of another flat cable. Cramping terminals 13A to 13G are thus securely held in cables 12A and 12B which have the desired thickness and rigidity. After forming the circuit by mounting the cramping terminals as described above, unnecessary portions of flat cables 12A and 12B (cross-hatched portions k, l, and m in FIG. 1) are cut off, e.g. by means of a press. Alternatively, the unnecessary portions may remain.

Once circuit component 20 has been completed, it is inserted into the interior of lower casing 10 of the junction box to rest on ribs 10*b* so that tabs 13*d* extending toward lower casing 10 project downward through terminal holes 10c. Subsequently, upper casing 11 is placed over lower casing 10 so that tabs 13*d* extending toward upper casing 11 project through the terminal holes (not shown) located therein. At this stage, ribs on the inner surface of upper casing 11 contact the upper surface of upper cable 12A, in a manner analogous to the insertion into lower casing 10. By assembling the junction box in this way, circuit component 20 is housed in the space defined by upper and lower casings 10 and 11, and the desired circuit construction is obtained.

Figure 5A:
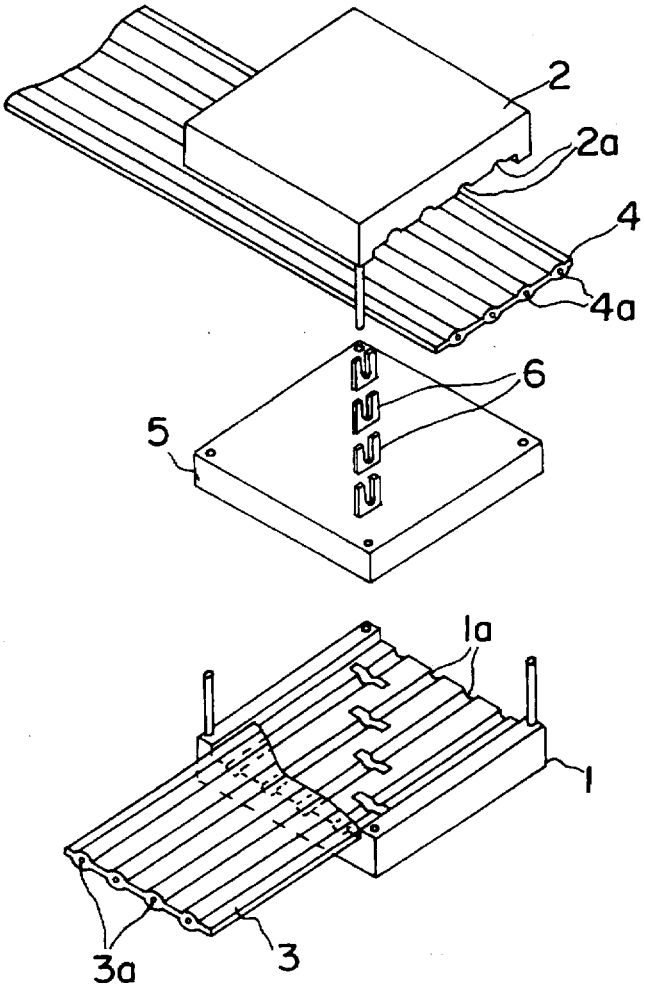
FIG. 5A PRIOR ART
FIG. 5 (A) is an exploded perspective view of a prior art connector for flat cables.
Figure 5B:
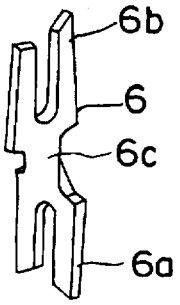
FIG. 5B PRIOR ART

Thus, the prior art positioning grooves on the inner surfaces of lower and upper casings 10 and 11 are rendered unnecessary, thereby reducing the cost of production. Further, cramping terminals 13A to 13G are inserted directly into and connected with the predetermined wires a to j and p to y of cables 12A and 12B which have been superposed. This obviates the need for the prior art connector main body as shown in FIG. 5. Therefore, casings 10 and 11 can be made thinner by an amount equal to the thickness thereof, resulting in the entire junction box being thinner.

Further, the direct insertion of cramping terminals 13A to 13G and their connection with the predetermined wires renders the circuit easy to modify, as well as making it more compact. In addition, unlike the prior art junction box, the wire arranging apparatus, and the labor required therefor, is not needed; this further contributes to the reduction in production cost.

As is clear from the foregoing description, a plurality of flat cables each comprising a plurality of parallel wires embedded in insulating resin are placed one over another, and the cramping terminals are inserted directly into the cables to connect the wires of different cables or of the same cable, thereby forming the desired circuit. The cramping terminals are securely held in the flat conductor members; therefore, the circuit component can be prepared in advance, independently of the casings of the junction box.

Another advantage of the Invention is that the wires of the flat cables can be arranged to intersect at any desired angle; if the wire contacts of the cramping terminals are of sufficient length, they can simultaneously connect the wires of different flat cables, and the cramping terminals can be easily and rapidly mounted from either direction. Furthermore, the junction box can be assembled merely by mounting the preformed circuit component in the spaced defined by the upper and lower casings. Accordingly, it can be very easily assembled. The ribs on the inner surfaces of the casings prevents the ends of cramping terminals from coming into contact therewith, thus avoiding damage thereto.

Although only a specific number of embodiments of the present Invention have been expressly described, it is, nonetheless, to be broadly construed and not to be limited except by the character of the claims appended hereto.

What we claim is:

1. A circuit component comprising:

a first flat cable having a first longitudinal axis, a second flat cable having a second longitudinal axis, said first cable having a plurality of first electrically conductive wires parallel to each other, first insulative connecting portions between adjacent said first wires, said second cable having a plurality of second electrically conductive wires parallel to each other, second insulative connecting portions between adjacent said second wires, said first cable superposed on said second cable to form a cable combination, said first axis being at a right angle to said second axis, at least one cramping terminal inserted in said first cable and in electrical contact with at least one of said first wires, whereby a plurality of contact legs on said cramping terminal passing through at least one of said second insulative connecting portions.

2. The component of claim 1 wherein said combination has an upper side and a lower side, said cramping terminal inserted from said upper side or said lower side.

3. The component of claim 1 wherein there is a plurality of cramping terminals.

4. The component of claim 1 wherein said cramping terminal electrically connects at least one of said first wires with at least another of said first wires.

5. The component of claim 1 wherein said cramping terminal electrically connects at least one of said first wires with at least one of said second wires.

6. The component of claim 1 wherein unused portions of said first flat cable or said second flat cable are cut off.

7. The component of claim 1 wherein said first wires and said second wires are each surrounded by an insulating coating.

8. The component of claim 7 wherein said cramping terminal comprises at least one wire contact, said wire contact being provided with a cutter which is adapted to penetrate said coating to make electrical contact with at least one of said wires.

9. The component of claim 1 wherein said cramping terminal comprises at least one wire contact.

10. The component of claim 9 wherein said cramping terminal has a contact tab remote from said wire contact, said contact tab extending out of said component to form an external terminal.

11. The component of claim 7 wherein said insulating coating comprises wire coatings surrounding each of said wires and connecting portions between adjacent said wire coatings, said wire coatings being thicker than said connecting portions.

12. The component of claim 11 wherein there are spaces between said connecting portions and inside surfaces of a housing for said component.

13. A junction box comprising at least one component according to claim 9 and housing therefor, said housing having at least one terminal hole, said cramping terminal having a contact tab remote from said wire contact, said contact tab extending through said terminal hole to form an external terminal.

14. The junction box of claim 13 wherein said housing comprises an upper casing and a lower casing, ribs on an internal surface of at least one of said upper casing and said lower casing.

15. The junction box of claim 14 wherein said component, when in said upper casing and/or said lower casing, rests against said ribs.

16. The junction box of claim 15 wherein there is a clearance between said component and said upper casing and said lower casing.

17. The junction box of claim 13 wherein said insulating coating comprises wire coatings surrounding each of said wires and connecting portions between adjacent said wire coatings, said wire coatings being thicker than said connecting portions.

18. The junction box of claim 17 wherein there are spaces between said connecting portions and internal surfaces of said junction box.

* * * * *